United States Patent [19]

Lapish

[11] Patent Number: 5,035,099

[45] Date of Patent: Jul. 30, 1991

[54] WALL TIE

[76] Inventor: Ernest B. Lapish, 84 Stamford Park Road, Mt Roskill, Auckland, New Zealand

[21] Appl. No.: 406,573

[22] Filed: Sep. 13, 1989

Related U.S. Application Data

[63] Continuation of Ser. No. 111,417, Oct. 20, 1987, abandoned.

[30] Foreign Application Priority Data

Oct. 31, 1986 [AU] Australia ..... 64622/86
Jul. 23, 1987 [AU] Australia ..... PI3293

[51] Int. Cl.[5] ..... E04B 1/38

[52] U.S. Cl. ..... 52/713; 52/565; 52/568

[58] Field of Search ..... 52/702, 710, 713, 714, 52/715, 353, 361, 379, 385, 389, 426, 427, 428, 562, 563, 564, 565, 568

[56] References Cited

U.S. PATENT DOCUMENTS 1,077,839 11/1913 Kingston ..... 52/702
1,365,054 1/1921 Matthews ..... 52/714
1,785,790 12/1930 Ropp ..... 52/702
1,934,760 11/1933 Awbrey ..... 52/710
1,942,863 1/1934 Johnstone ..... 52/713
3,238,684 3/1966 Wood ..... 52/379
4,064,664 12/1977 Gaul ..... 52/385
4,543,760 10/1985 Barker et al. ..... 52/713
4,606,163 8/1986 Catani ..... 52/710
4,607,472 8/1986 Pointner ..... 52/702

*Primary Examiner*—Michael Safavi
*Attorney, Agent, or Firm*—Young & Thompson

[57] ABSTRACT

A wall tie connector for masonry-veneer, panels, or curtain-wall claddings, has a ductile attachment plate for attachment to a support frame or to the masonry, the panel, or the curtain wall, and has a pair of protruding apertured flanges in which a ductile bar with at least one keying portion is keyed into an aperture to prevent rotation about its longitudinal axis. A retaining tie member is slideably mounted on the bar, and is connectable to masonry veneer, a panel or a curtain wall, or to a support member. The ductile attachment plate may have secondary flanges orthogonal to the main apertures flanges, and so arranged as to penetrate an insulation layer or to key into a masonry wall.

2 Claims, 6 Drawing Sheets

Figure 1:
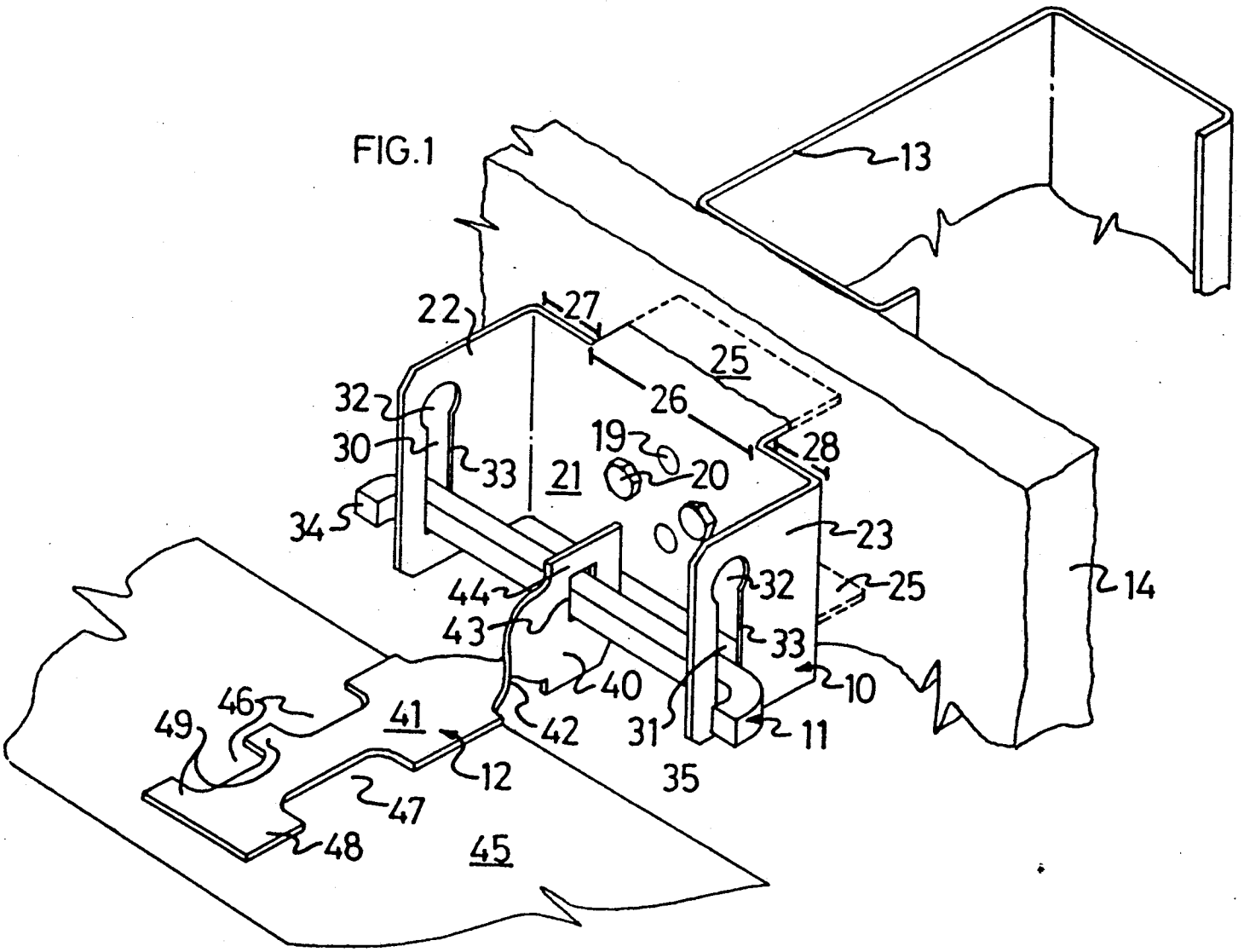

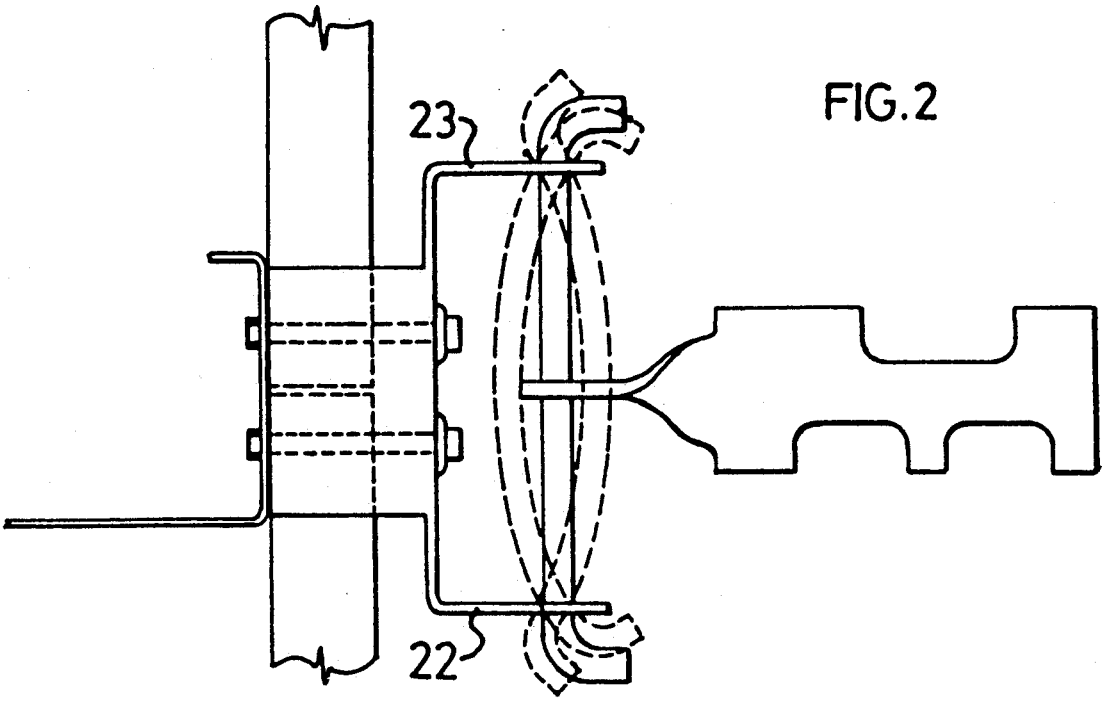
FIG. 2
FIG. 3
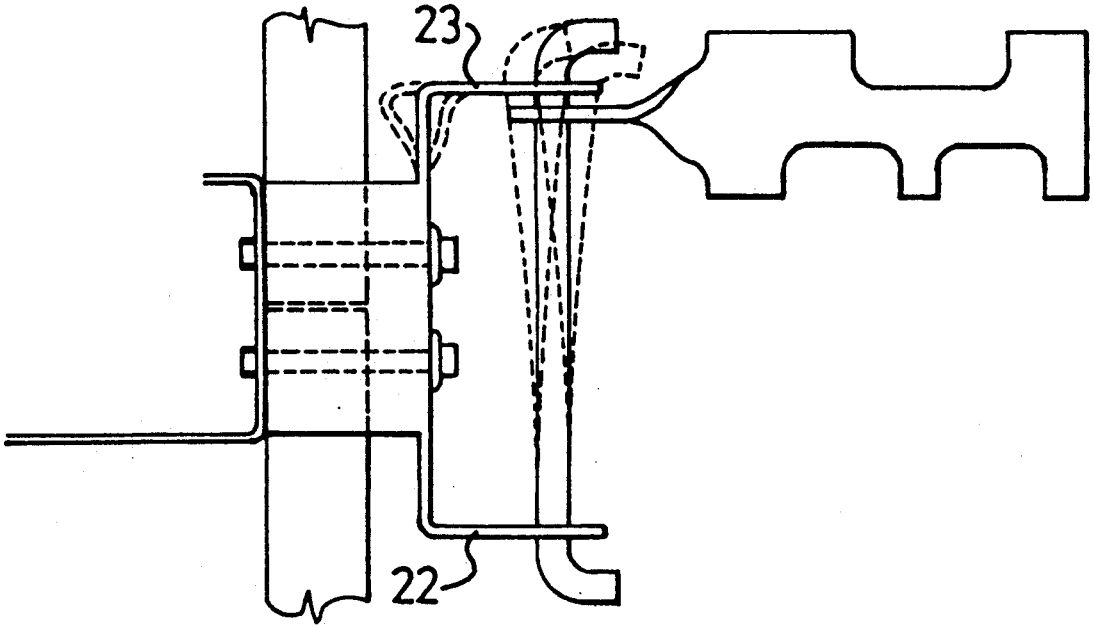

WALL TIE

This application is a continuation of application Ser. No. 111,417, filed Oct. 20, 1987, now abandoned.

FIELD OF THE INVENTION

This invention relates to a method and means for tying cladding such as glass curtain walls, or panels, or block or brick veneers to an accompanying framework, and has particular application for the accommodation of substantial in-plane movement of the framework structure vertically, horizontally, or pivotally with respect to the cladding, whilst at the same time accommodating out-of-plane stresses arising from applied face loads.

The invention has particular, though not sole, application to aseismic wall connections.

BACKGROUND

The construction of brick or block buildings, and glasswalled buildings, is often performed with the use of a wooden, concrete or metal frame as the supporting member, to which the outer wall, or "veneer", of bricks or blocks or panels or glass is linked by ties to prevent it from toppling outwards. It is well recognized by structural engineers experienced in the aseismic design of buildings that brittle non-structural elements such as masonry veneers, precast panels or curtain wall constructions must be separated from the seismic resisting frame so as not to modify the seismic response of a building structure subjected to lateral loads.

Substantial relative dynamic in-plane displacements of the veneer and the frame may occur under seismic attack during an earthquake, or under severe wind loadings, and can result in failure of currently known ties, resulting in severe damage to veneer walls and/or the support structure. Other strains apply in wooden-framed brick or block veneer buildings in the period after construction, when the wooden frame has a tendency to shrink and/or warp slightly as it loses moisture to the atmosphere, and the brick or block veneer expands as moisture from the atmosphere is absorbed.

PRIOR ART

Many different attempts have been made to provide veneer anchors to interconnect a veneer wall such as a masonry wall to a supporting frame work. These attempts have concentrated on the provision of a certain degree of adjustment between an anchor attached to a support, and a wall tie which is secured to the masonry wall, by embedding it into the mortar layer between masonry units.

SCHWALBERG U.S. Pat. No. 4021990

Discloses a veneer anchor and dry wall construction system and method which utilises a wire U-shaped or V-shaped tie capable of moving vertically with respect to a channel formed in a anchor plate having a vertically projecting bar portion.

DAVIES U.S. Pat. No. 3213576

Discloses a fastening mechanism for the marble front of a burial crypt. This is concerned with a plate which is securely anchored to a concrete wall, the plate being slotted, so that its position can be adjusted vertically, prior to fixing, so that a marble facing can be supported on a ledge extending from the plate.

HUSLER U.S. Pat. No. 3788021

Discloses an interconnection system for structural elements. It is concerned with the provision of an elastomer between two channels, so that the two channels are resiliently connected together and also insulated one from the other.

HALA U.S. Pat. No. 4021989

Discloses a rotatably pivotal stone anchor and stone anchor construction system. This system allows for rotational adjustment of one end of the anchor from the other, allowing one end to be fixed to a concrete wall, with the other having a button on the end thereof capable of fitting into a recess in an outer masonry plate.

LOPEZ U.S. Pat. No. 4473984

Discloses a curtain-wall masonry-veneer anchor construction. This utilises an eye bolt, connected to a V-shaped wire tie.

CHAMBERS U.S. Pat. No. 3715850

Discloses an adjustable mounting device. This uses a circular plate having a plurality of apertures therein, enabling it to be positioned in any one of a number of positions relative to a slotted plate.

HOHMANN U.S. Pat. No. 4598518

Discloses a pronged veneer anchor and dry wall construction system. This utilises a U-shaped or V-shaped wire tie similar to that of Schwalberg described above.

ALLAN U.S. Pat. No. 4373314

Discloses a masonry veneer wall anchor. This shows an L-shaped metal bar having a series of slots in the protruding vertical face thereof, each slot of which can receive a triangular wire tie, allowing the wire tie to be inserted in the slot, for vertical adjustment during placement of the tie on the relevant brick surface during construction of the masonry wall.

STORCH U.S. Pat. No. 3377764

Discloses anchoring means for masonry walls. This shows a pair of perpendicular interconnected wire loops, each of which can be embedded in the mortar layer of separate masonry walls which are to be tied together.

BARGTEHEIDER West German Patent 2905238A

Discloses a "wall facade substructure". This has asymmetrically shaped wall and facade profiles allowing for relative vertical displacement by the provision of two channels, one of which has a series of vertical slots therein by which it may be attached to the other channel.

It will be noted that some of these connectors provide for vertical and to a lesser extent horizontal adjustment of the tie relative to an anchor plate during installation. However these prior art connectors were not designed to resist seismic attack or other dynamic movements. Some of them are suitable only for adjustment during installation and are then locked fixedly in place. This may be suitable for masonry to masonry cavity connections but is not suitable for veneer wall constructions where significant relative displacements of a veneer wall and its support are possible.

For example, the Schwalberg tie consists of a vertical bar (26) which restrains a horizontal tie (56). When the out of plane seismic load is applied to the tie at the mid-span of the bar, the bar can only bend outwards on each reversal of the cyclic loading, so that the vertical bar bends into the shape of a hoop. This bending in one direction only thus increases the slackness between the components, thereby radically altering the shape and symmetry of the hysteresis loop. When the Schwalberg horizontal tie is at the bottom, or top of the vertical bar, the shape of the hysteresis loop will be completely different when compared with the mid span position.

All the other cited ties of a similar configuration will have these types of irregular and unpredictable hysteresis cyclic performance loops.

STATEMENT OF INVENTION

It is an object of this invention to provide an improved wall tie connector which allows for considerable in-plane movements of a veneer relative to its support frame, without compromising significantly the degree by which the veneer is supported by the frame.

In one aspect, the invention provides a wall tie connector for connecting a first wall structure to a second wall structure including: a ductile attachment plate having means for attachment to a first wall structure, said attachment plate having a pair of main flanges protruding from the plane of the attachment plate, each flange having an aperture therein; a ductile elongate member which can be secured to said attachment plate by passing through said apertures in said main flanges; a retaining member having means at or adjacent a first end thereof for attachment to a second wall structure, said retaining member having an aperture at or adjacent a second end thereof through which the ductile elongate member can pass to connect said retaining member to the attachment plate; wherein the ductile elongate member can be keyed to at least one of said apertures to prevent rotation of the elongate member about its longitudinal axis; and wherein said retaining member aperture is only slightly larger than the width of the elongate member so that in use the retaining member is closely coupled to said elongate member in the axial direction of the retaining member and forms a sliding fit thereon so as to allow the retaining member to slide from side to side along the elongate member.

The width of the elongate member being measured in the direction of the major axis of the retaining member as this is the direction of push/pull forces exerted by face loads, e.g. as may be experienced in an earthquake.

The elongate member is in the form of a rod having at least one keying portion along its length (called the "keyed rod") so that it can be keyed into complementary shaped apertures in one or both of the flanges or the aperture in the retaining member (or two or more of them) and so prevented from rotating about its longitudinal axis.

In its simplest form the elongate member may comprise a coach or carriage bolt which has a short neck length adjacent the head with a pair of flats which enables it to be keyed against rotation by fitting closely into a corresponding flat sided aperture in one of the main flanges.

More preferably the elongate rod has at least a pair of opposite flat longitudinal faces along its length to key it to "vertical" substantially rectangular slots within each of the main flanges and also to key it to a substantially rectangular aperture or substantially rectangular "vertical" slot in the retaining member. Other cross-sections can be used, e.g. the rod could have a polygonal cross-section with a multiplicity of "flats" or, the rod could have a circular cross-section with a spline or an arcuate cut along its length to give a portion within the rod such that the rod slides in to a complementary aperture in at least the retaining member which in turn prevents the rod from rotating. Conveniently the rod has a square cross-section, and is formed with pre-bent ends, to prevent lateral displacement of the rod relative to the flanges.

Where the rod has pre-bent ends it will be generally convenient to provide key-hole type slots in the flanges, with the enlarged portion of the key-hole slots towards the top, so that the pre-bent square cross-section rod, with its associated retaining tie member can be inserted through the larger upper end of the slots, and then rotated through 90° to lock it in place.

Where the wall structure (e.g. a stud) is covered by insulation it is preferred that the attachment plate has additional central stiffening means such as central orthogonal flanges which can penetrate the insulation layer covering the supporting framework, and keep main face of the attachment plate spaced away from the insulation layer.

DRAWINGS

These and other aspects of this invention, which should be considered in all its novel aspects, will become apparent from the following description which is given by way of example only, with reference to the accompanying drawings, in which:

FIG. 1: illustrates a perspective view of a first embodiment of the wall tie, connecting a masonry veneer to an insulation covered metal stud.

FIG. 2: illustrates a top plan view of the wall tie of FIG. 1, showing the possible ductile bending movement of the rod.

FIG. 3: illustrates a top plan view of the wall tie of FIG. 1, showing the retaining member at the extreme end of the rod, and shows possible ductile bending movement of the cantilevered end of the attachment member.

Figure 4:
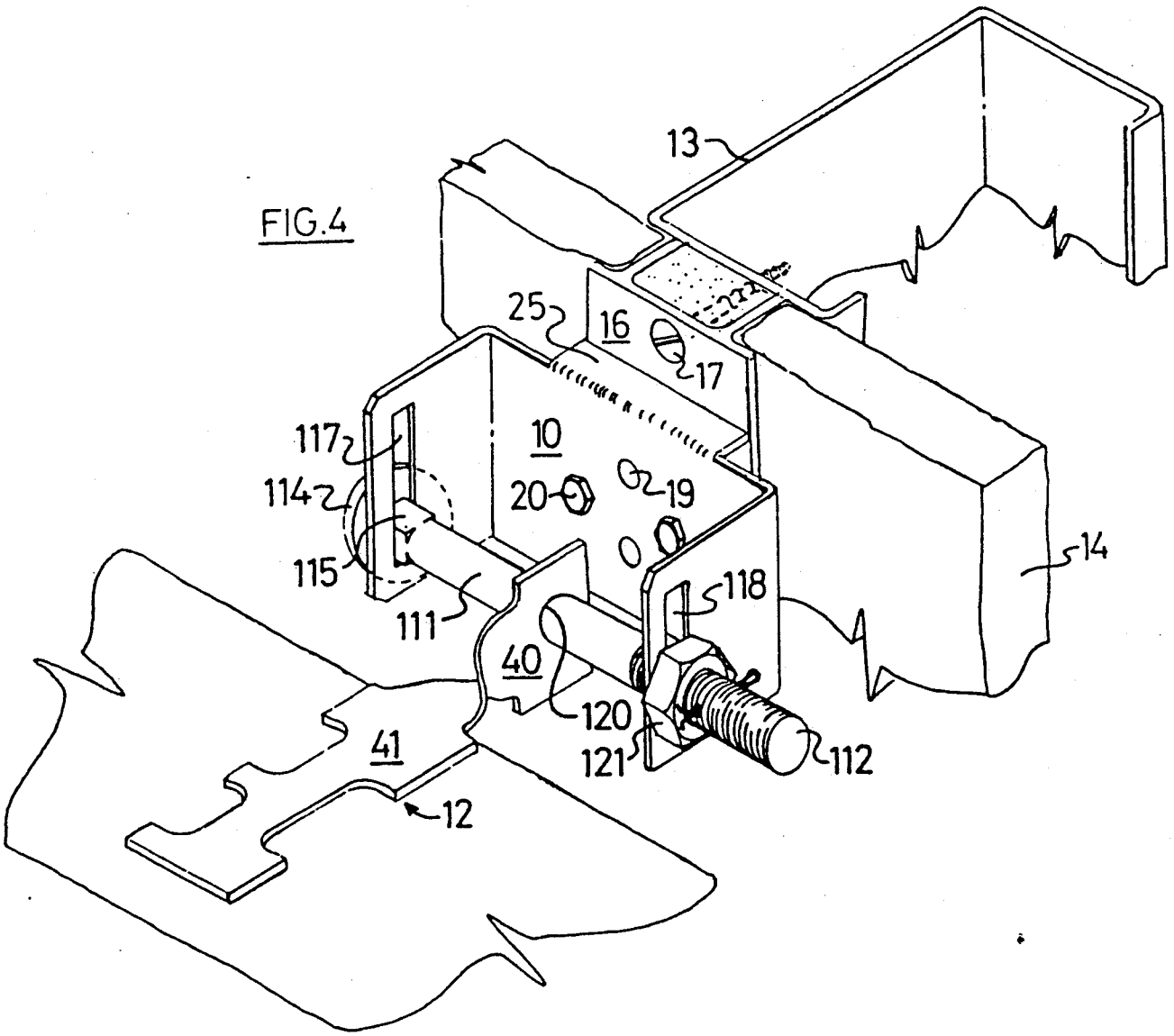

FIG. 4: illustrates a perspective view of a second embodiment, in which the attachment plate is connected to a load bearing bracket, which is in turn connected to the metal stud.

Figure 5:
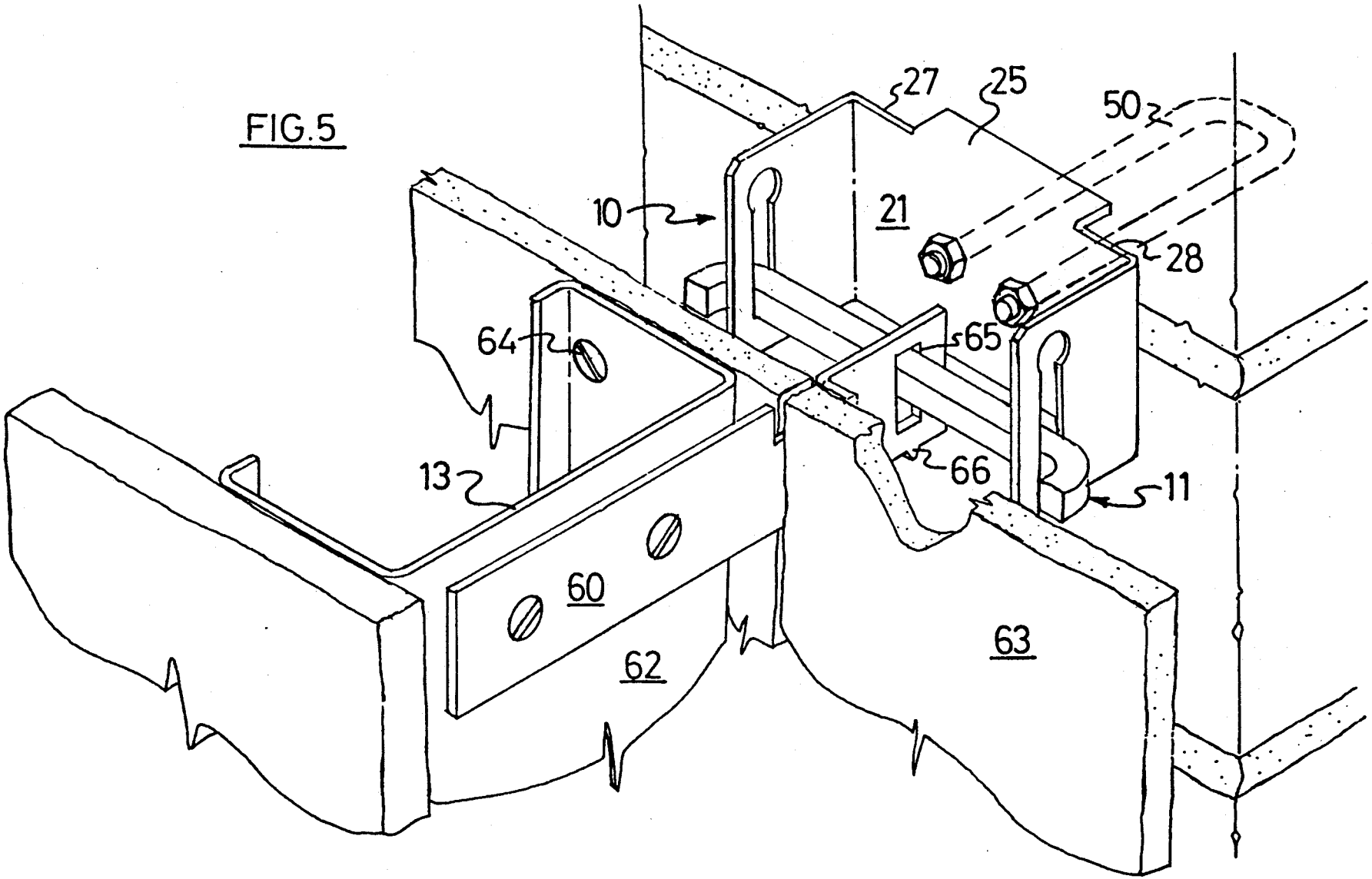

FIG. 5: shows a third embodiment of the invention, in which the attachment plate is turned around and attached directly to a masonry veneer wall, whilst the retaining member is connected directly the supporting metal stud framework.

Figure 6:
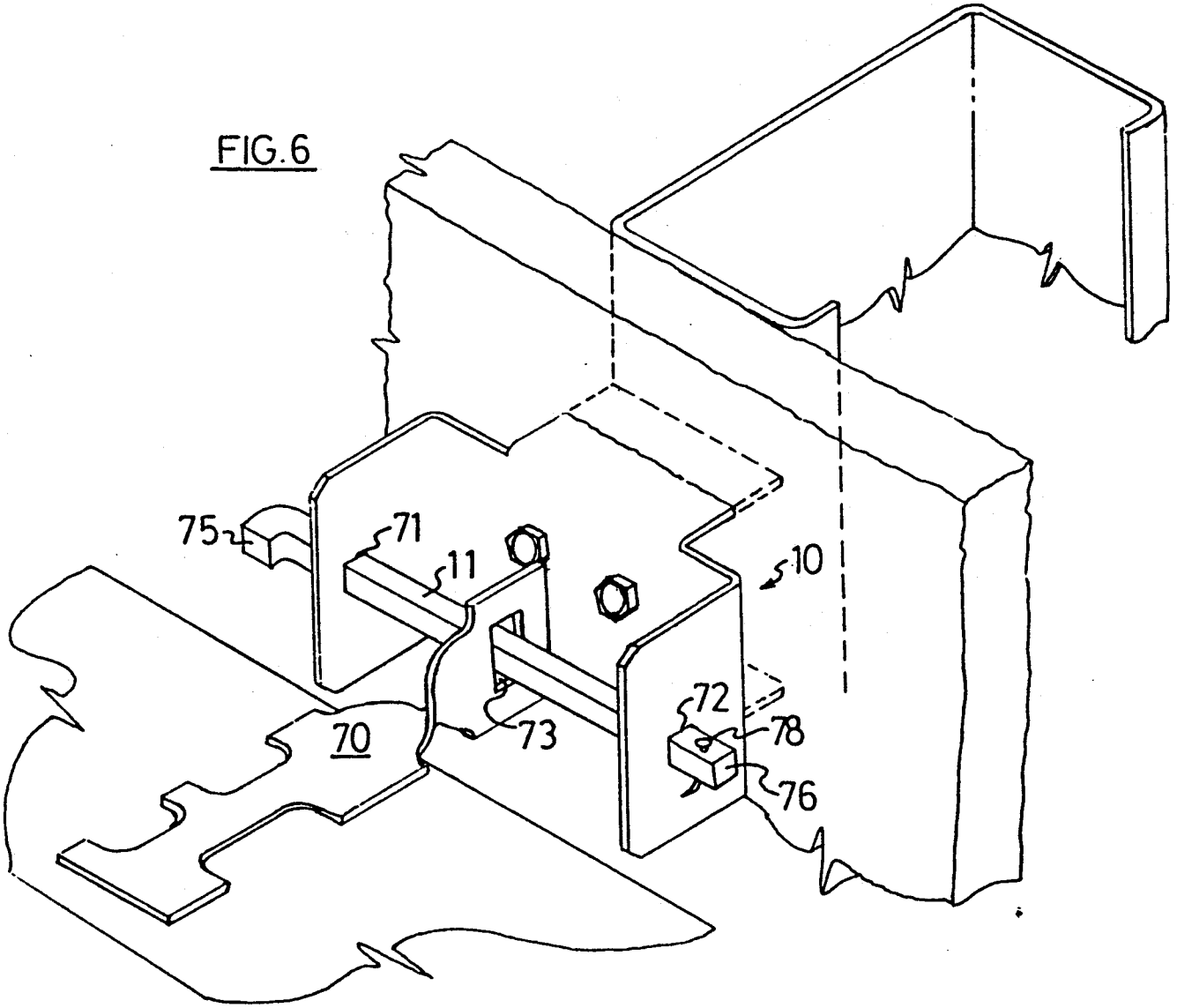

FIG. 6: shows a fourth embodiment of the invention, in which the attachment plate has the ductile rod fixed in place, and the retaining member has a slot in one end.

Figure 7:
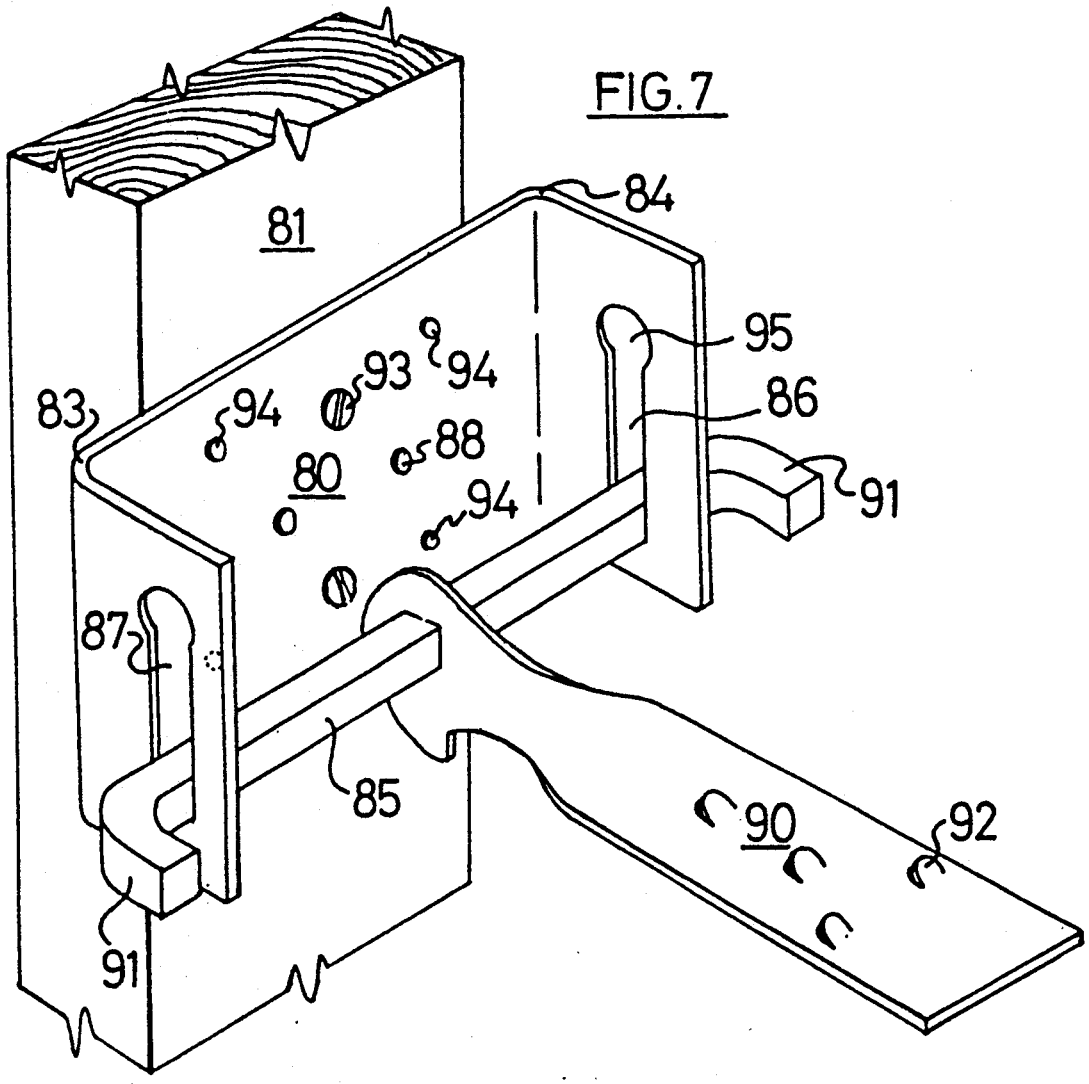

FIG. 7: shows a fifth embodiment of the invention, in which a simplified attachment plate is secured to a timber stud.

FIRST EMBODIMENT-FIGS. 1-3

The wall tie of FIG. 1 has three main components, an attachment plate 10, a keyed rod 11 and a retaining member 12.

The attachment plate 10 has a single or a plurality of apertures 19 for the reception of fasteners 20, which are preferably self-tapping screws, bolts or the like for attachment to a stud 13, which is shown as a metal stud, covered by a layer of insulation 14.

The attachment plate 10 has a main face 21 through which the fasteners can pass, a pair of protruding flanges 22, 23, and a pair of orthogonal flanges 25, capable of piercing the layer of insulation 14 and pressing against the end wall of the metal stud 13 so that the main face 21 stands proud of the layer of insulation (as shown in FIGS. 2 and 3).

It is preferred that the flanges 25, stop short of the slotted flanges 22, 23 so that the central portion indicated by numeral 26 is supported by the flanges 25, but the outer edges of the main face 21 are unsupported in the regions marked 27–28. The importance of these unsupported regions 27, 28 will become apparent from an inspection of FIG. 3.

The flanges 22, 23 are provided with substantially rectangular slots 30, 31 which are preferably in the form of "key-hole" type slots, having an enlarged substantially circular upper portion 32, and a main portion 33 having straight sides. The main portion 33 is preferably only slightly wider than the width of the keyed rod 11. Indeed, the rod 11 is preferably of rectangular, or more preferably square cross-section, so that it can slide up and down the main portions 33 of the slots, but is prevented from rotating within the main portion of the slots. Nevertheless, the upper circular portions 32, are preferably sufficiently large that the square cross-section rod 11 can be rotated in this portion of the slots.

Preferably the square cross-section rod 11, is provided with pre-bent ends 34, 35 which are bent at substantially right angles to the main axis of the rod, to restrain the ends of the rod from passing through the main portions 33 of the slots, i.e. to prevent the rod from falling out of the slots when in service.

The retaining member 12 has a substantially vertical portion 40, and a substantially horizontal portion 41, i.e. it has a twisted neck 42 joining the two ends together so that one end can be slotted onto the rod, and the other end attach to a masonry veneer wall 43.

Preferably the end 40 has an aperture 43 therein which has a width 44 only slightly larger than the corresponding width of the rod 11 so that the retaining member 12 forms a sliding fit on the rod 11, and can slide along the length of the rod. By this means, the retaining member 12 is closely coupled to the rod 11, in the axial direction of the retaining member 12, as will be explained below. As shown in FIG. 1, the aperture 43 is square to correspond to the cross-section of the rod 11, although this aperture could be of any other suitable shape, e.g. containing at least one flat so that it prevents the rod from rotating and is closely coupled to the square cross-section of the rod.

The horizontal portion 41 of the retaining member, preferably has recesses 46, 47 surrounded by fins 48, 49 to assist in keying the horizontal portion 41 into the mortar-masonry veneer wall and for the engaging of vertical reinforcing bars located in the veneer.

It is particularly preferred that both the attachment plate 10, and the rod 11, are formed of ductile materials. It will be generally convenient to form them of ductile steels, and by way of example, the following steels are suggested: structural mild steel, which is preferably plated, or one of the varieties of stainless steel. Other alloys may be used, and it will be apparent to those skilled in the art, that the ductile nature of these components can be chosen as required. It is preferred that if the ductile material is a metal which is subject to corrosion, that the metal be coated with a compatible anti-corrosion layer, such as zinc, e.g., by hot-dip galvanizing after fabrication.

OPERATION OF FIRST EMBODIMENT

In use, the wall tie can be readily assembled and installed by tradesmen. The retaining member 12 can be fed on to the keyed rod 11 (or supplied as a pre-assembled pair). The attachment plate 10 can be secured to a stud 13 by pushing the flanges 25 through the insulation layer 14 then using fasteners 20 such as screws or bolts, rivets, nails, etc. passing through apertures 19, through the insulation layer 14, and into engagement with the stud 13. The fasteners can be used to pull the ends of the flanges 25, tight against the end wall of the stud, so that the central region 26 of the attachment plate is stiffened.

The retaining member 12 and rod 11, can now be attached to the attachment plate, as the retaining member is held with portion 41 in the vertical position, i.e. with the ends of the rod 11 facing upwardly, and one end passing through the enlarged end 32 of the slots.

The other end of the rod 11, is then passed through the other slot, and the entire assembly pulled upwardly until the rod is positioned in the enlarged upper ends 32 of both slots. At this point, the rod 11 can be rotated through 90°, until the portion 41 of the retaining member 12 is in a substantially horizontal position, and then the rod and retaining member can be slid down the slots until it reaches the position shown in FIG. 1. The retaining member 12 can then be bedded into the mortar of the masonry veneer wall, and further masonry elements, i.e., bricks or blocks can be built up on the wall in order to cover the horizontal portion 41. The wall will then be built up until another wall tie is required, and the process repeated.

FIGS. 2 and 3 show the displacement of the ductile members, i.e. the ductile rod 11, and the ductile attachment plate 10, under severe face load.

If the retaining member 12 is positioned about the mid portion of rod 11, then face loads will cause the rod to flex back and forth in the bending manner shown in FIG. 2. Extreme bending movement at the central portion of the rod 11 may also result in flexing of the ends of the flanges 22, 23.

If the retaining member 12 is at one or other end of the rod 11, then severe face loads will cause the appropriate flange, in this case flange 23 to flex back and forth about the unsupported portion 28 of the main face 21 (which is sufficiently clear of the insulation layer to allow it to flex back and forth as shown in FIG. 3).

The retaining member 12 may be formed of any suitable material, e.g. metal or plastic. It need not be ductile, and in the case of a plastic retaining member 12, it will likely be of an elastic plastics material with a configuration such that portions 40 and 42 are strengthened to prevent deformation under axial horizontal loadings.

SECOND EMBODIMENT-FIG. 4

In the second embodiment, the attachment plate 10 does not directly contact the stud 13, but instead contacts a load bearing bracket 16, which in turn connects to the stud 13 by appropriate fasteners such as screws 17 or the like. It will generally be convenient to provide additional apertures (not shown) in this bracket 16, so that the screws or other fasteners passing through the attachment plate 10, secure it to the load retaining bracket 16, and also to the stud 13. Depending upon the thickness of the insulation layer 14, the attachment plate 10 may be connected only to load bearing bracket 16.

In this case the rod which cannot rotate relative to bracket 16 is a coach bolt 111 having a circular cross-section shank for most of its length, a short threaded portion 112 at one end, and a short keying or non-circular portion 113 at the other end adjacent a head 114. The keying portion is provided by a pair of opposite flat faces 115 (which are oriented vertically so as to fit snugly within the slot 117 and prevent rotation of the bolt about its longitudinal axis). Conveniently the flats 115 are of such a size that the bolt can only be inserted in slot 17 in the orientation shown in FIG. 4.

The retaining member 12 has a circular aperture 120 in end 40, so that it is closely coupled to the bolt in its axial direction, but can slide from side to side of the bolt.

In use, the free end 112 of the bolt 111 is passed through slot 117, aperture 120 of the retaining member, then slot 118 as shown. A nut 121 or other securing means is used to hold the bolt in place and prevent the keying portion 115 from escaping from the slot 117. The nut may be secured by appropriate locking means such as an anaerobic adhesive, locknut, split pin, or the like.

THIRD EMBODIMENT - FIG. 5

This shows the use of an attachment plate 10 of the same style as that shown in FIG. 4 (i.e. with the shorter orthogonal flanges 25, shown in FIG. 1), but in this case with the attachment plate 10 secured to a masonry veneer wall rather than to a stud. The attachment to the masonry veneer, can be by way of a threaded brick tie 50 embedded in a mortar layer 51 between bricks 52, 53.

A retaining member 60 is connected to a stud 13, by means of screws or the like, passing through the main wall 62 of the stud. An insulation layer 63 is conveniently connected to the end wall of the stud by appropriate fasteners 64. Note that the retaining member which is positioned vertically, will cut through a portion of the insulation.

It is preferred that the retaining member has an elongated slot 65 of substantially rectangular cross-section, which is again closely coupled to the rod 11, in the axial direction of the retaining member, but allows the retaining member to move up or down with respect to the rod.

It is preferred that the retaining member also has a drip lug 66 positioned below the slot.

Assembly and operation of the third embodiment is similar to that of the first embodiment, except that the attachment plate 10 is secured to the masonary veneer wall, with its flanges 25, acting to space the main face 21 away from the face of the masonry veneer, to enable the ends 27, 28 to flex in the manner shown in FIG. 3. In use the rod 11 can also flex in the manner shown in FIG. 2.

FOURTH EMBODIMENT - FIG. 6

This shows an embodiment similar to FIG. 1, but with the keyed connector rod 11, fixed in place within two apertures 71, 72, and the retaining member 70 having a vertical slot 73 which allows the up and down movement of the retaining member 70 relative to the attachment plate 10.

Preferably one end 75 of the rod 11 is bent over, whilst the other end 76 is straight so that the rod can be inserted from either end, but inserted from the left in the example shown i.e. through the complementary (square) aperture 71, through slot 73, then through aperture 72, and held in place by suitable fastening means e.g. a pin 78 which may be secured in place. Many other fastening means may be used.

FIFTH EMBODIMENT - FIG. 7

This shows a simplified attachment plate 80 nailed flush against the face of a timber stud 81 so that the flanged ends 83, 84 of the plate overhead the sides of the stud. A square-section rod 85 is keyed into the lower portion of slots 86, 87 in the flanges against rotation relative to plate 82 and to a square hole 88 in the end of a retaining member 90. The rod may have pre-bent ends 91 as shown.

Screws 93 can be used to tightly hold the centre of the plate 80 against the stud, with nails in apertures 94 near the edges of the stud to provide additional stiffening means. Different nailing patterns can be used depending upon the extent of stiffening required and the nails could also replace the screws 93. Alternatively, pre-formed nail-plate fixings may be punched in the attachment plate and used to secure the attachment plate to the stud.

The slots 86, 87 can have key-hole ends 95 to facilitate entry of the rod 85 (as previously described).

The retaining member 90 can have tabs 92 to assist in keying it into the mortar of a masonry veneer wall.

Such a configuration can be used with studs of wood, metal, or any other material which are not covered by a layer of insulation.

ADVANTAGES

In the foregoing embodiments, horizontal movement is made possible by the retaining member sliding along the rod, vertical movement is possible with the rod sliding in the slots in the attachment plate 4 (embodiments 1–3 or 5), or the slot in the retaining member (embodiment 4), and rotational movement is made possible about the major axis of the tie by the combined left or right hand pivotal actions of the sliding vertical and horizontal components. Additionally, out-of-plane face loads can be accommodated by:

(a) the rod as shown in FIG. 2 flexing back and forth in the manner of a ductile simply supported beam (as it is prevented from rotating about its axis and thus prevented from flipping over); and (b) by cantilever flexing of the ductile attachment plate when out-of-plane face loads are applied to either end of the ductile rod as shown in FIG. 3.

The wall tie connector of this invention is so structured that the flexural components, together with their closely coupled mechanism provides a controlled symmetrical cyclic hysteresis load deflection loop, having a constant pinch of the loop due to the sliding fit and slackness between the component parts, but able to resist out-of-plane loads irrespective of the location of the retaining member along the elongate member, or of its vertical positioning in the slotted flanges of the attachment plate or in the slot contained in the retaining member.

VARIATIONS

The stiffening means may take the form of an additional central rectangular plate or washer in front or behind the main face of the attachment plate. Or it may take the form of orthogonal flanges facing away from the stud (i.e. towards the retaining member), or the plate main face 21 may be swaged, or in the case of direct contact with the stud (as in FIG. 7) the centre of the attachment plate may simply be tightly held against this face of the stud.

Many different types of attachment means may be used to attach the attachment plate to a first wall structure such as a stud. In addition to the bolts, screws, nails or nailingplates mentioned above, appropriate adhesives may be used, or the stud may be provided with a channel or recess into which a part of the attachment plate may be fitted.

The rod is prevented from rotating about its longitudinal axis by the interaction of at least part of the length of the rod and one or more of the apertures in which the rod is positioned. Thus the rod may be a coach bolt, or a square section or polygonal section bar or have a positive or negative arcuate profile to make with a negative or positive arcuate profile in the ductile elongate member.

Finally, it will be appreciated that various alterations or modifications can be made to the foregoing without departing from the spirit or scope of this invention.

I claim:

1. A wall tie connector for connecting a first wall structure to a second wall structure including:

a ductile attachment plate having a substantially planar main face and having means for attachment to a first wall structure, said attachment plate having a pair of main flanges protruding from said main face, each flange having an aperture therein;

a ductile elongate member which is a rod having a substantially square cross-section and having a length and breadth and height, said ductile elongate member being secured to said attachment plate by passing through said apertures in said main flanges;

a retaining member having means adjacent a first end thereof for attachment to a second wall structure, said retaining member having an aperture adjacent a second end thereof through which the ductile elongate member passes to connect said retaining member to the attachment plate;

the ductile elongate member having surfaces along at least part of the length thereof in contact with complementary surfaces bounding at least one of said flange apertures, said surfaces being so shaped as to prevent rotation of the elongate member about a longitudinal axis thereof relative to said flanges;

said retaining member aperture being closely coupled to said elongate member in an axial direction of the retaining member and forming a sliding fit thereon so as to allow the retaining member to slide from side to side along the elongate member;

at least one of said flange apertures comprising an elongated slot which is substantially perpendicular both to the axial direction of the retaining member and to the length of the elongate member, thereby to allow relative movement between said retaining member and said attachment plate in a direction parallel to said slot.

2. A wall tie connector for connecting a first wall structure to a second wall structure including:

a ductile attachment plate having a substantially planar main face and having means for attachment to a first wall structure, said attachment plate having a pair of main flanges protruding from said main face, each flange having an aperture therein;

a ductile elongate member having a length and breadth and height, said ductile elongate member being secured to said attachment plate by passing through said apertures in said main flanges;

a retaining member having means adjacent a first end thereof for attachment to a second wall structure, said retaining member having an aperture adjacent a second end thereof through which the ductile elongate member passes to connect said retaining member to the attachment plate;

the ductile elongate member having surfaces along at least part of the length thereof in contact with complementary surfaces bounding at least one of said flange apertures, said surfaces being so shaped as to prevent rotation of the elongate member about a longitudinal axis thereof relative to said flanges;

said retaining member aperture being closely coupled to said elongate member in an axial direction of the retaining member and forming a sliding fit thereon so as to allow the retaining member to slide from side to side along the elongate member;

at least one of said flange apertures comprising an elongated slot which is substantially perpendicular both to the axial direction of the retaining member and to the length of the elongate member, thereby to allow relative movement between said retaining member and said attachment plate in a direction parallel to said slot;

the attachment plate having additional central stiffening means to provide a central region which is stiffer than the portions of the main face immediately adjacent said main flanges to allow ductile movement of the main flanges, said stiffening means comprising a pair of rearwardly extending stiffening flanges which are positioned substantially centrally of the main face of the attachment plate.

* * * * *